US005669333A

United States Patent [19]

Phelps, Sr.

[11] Patent Number: 5,669,333

[45] Date of Patent: Sep. 23, 1997

[54] ONCE-THROUGH STEAM GENERATOR FURNACE OUTLET FLUID MIX TO MINIMIZE THE NUMBER OF HEADERS AND RISER MATERIALS

[75] Inventor: Calvin Eugene Phelps, Sr., Akron, Ohio

[73] Assignee: The Babcock & Wilcox Company, New Orleans, La.

[21] Appl. No.: 600,616

[22] Filed: Feb. 13, 1996

[51] Int. Cl.[6] ..... F22B 37/14; F22B 37/20; F22B 37/22

[52] U.S. Cl. ..... 122/6 A; 122/406 S; 122/235.23

[58] Field of Search ..... 122/6 A, 235.11, 122/235.12, 235.15, 235.22, 235.23, 235.24

[56] References Cited

U.S. PATENT DOCUMENTS 3,476,090 11/1969 Sheikh ..... 122/235.11
3,665,893 5/1972 Barberton et al. ..... 122/6 A
3,796,195 3/1974 Gorzegno ..... 122/406 S
5,201,282 4/1993 Albrecht ..... 122/235.23

*Primary Examiner*—Henry A. Bennett
*Assistant Examiner*—Gregory Wilson
*Attorney, Agent, or Firm*—Robert J. Edwards; D. Neil LaHaye

[57] ABSTRACT

An arrangement for a furnace of a once-through steam generator includes a fluid mix header for holding a volume of a furnace mix fluid. A plurality of side wall tubes at the side wall of the furnace are connected to a side wall header. A roof outlet header is located at the roof of the furnace and a roof tube is connected at one end to the roof outlet header and at the opposite end to one end of a loop section of tube. A front wall tube located at the front end of the furnace is connected at one end to the opposited end of the loop section of the tube from the roof tube. A connection tube is connected between the roof outlet header and the fluid mix header. Rear and front screen tubes are connected directly to the fluid mix header of the furnace. Fluid from the fluid mix header is provided to the convection pass downcomer and convection pass tube enclosures of the steam generator.

2 Claims, 1 Drawing Sheet

FIG. 1
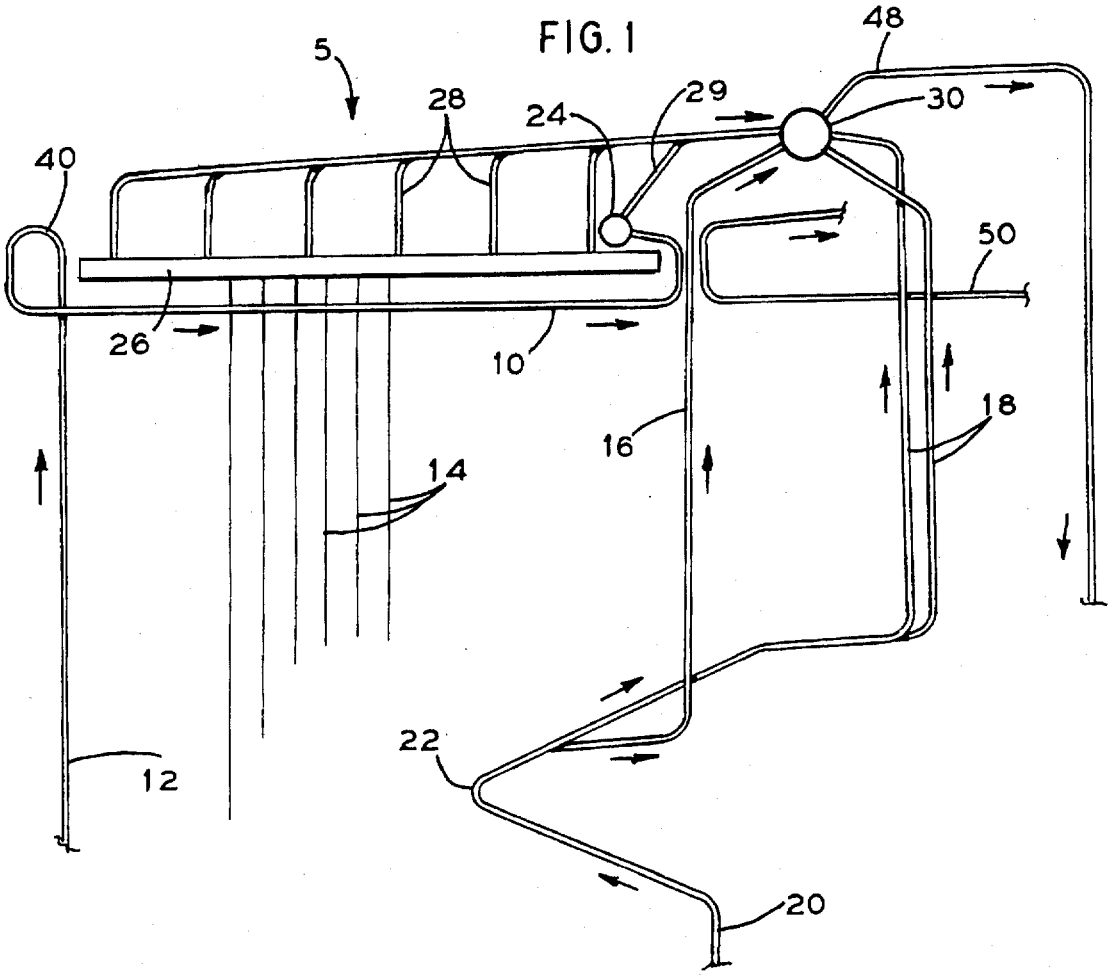
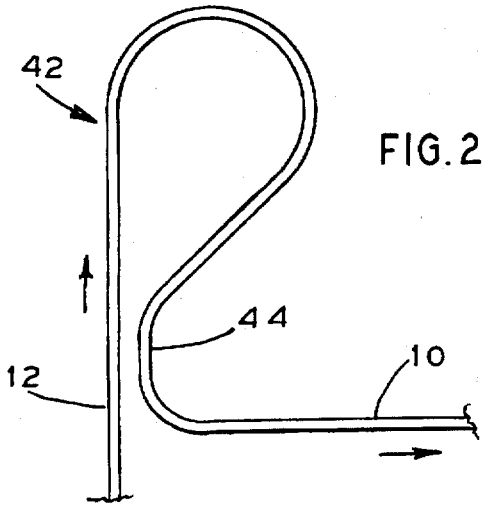
FIG. 2

ONCE-THROUGH STEAM GENERATOR FURNACE OUTLET FLUID MIX TO MINIMIZE THE NUMBER OF HEADERS AND RISER MATERIALS

FIELD AND BACKGROUND OF THE INVENTION

The present invention relates, in general, to a steam generator fluid circulation system.

In the power plant field, it is common to utilize furnace outlet circuitry to the fluid mix header for a once-through steam generator with many variations. But generally, each circuit is designed with separate outlet headers for each side wall, front and rear wall circuit of the furnace, and for each screen circuit, before flowing through risers to the fluid mix header. The roof inlet header at the front of the unit or the roof outlet header at the rear of the unit are normally the furnace outlet total fluid mix headers. These known circuits use a considerable amount of materials for the risers and headers in order to collect and make the fluid mix.

SUMMARY OF THE INVENTION

The present invention minimizes the number of headers and riser materials that are normally associated with known steam generator outlet fluid circuits. The front wall outlet headers and the roof inlet headers found in the known systems are eliminated. The present invention replaces these features with a furnace front wall support loop having continuous tubing routed from the front wall to form a furnace roof tube. This circuit provides fluid flow to a furnace roof outlet header and then through risers to a fluid mix header. Side wall tubes are routed to a side wall outlet header(s), which is routed through risers to the fluid mix header. Front and rear screen tubes are also routed directly to the fluid mix header in lieu of using outlet headers and risers to route the fluid, for example, to the front of the unit for completing the fluid mix.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a schematic view illustrating a furnace outlet circuit for a once-through steam generator according to the present invention; and FIG. 2 is a schematic view illustrating an embodiment of a loop section used in conjunction with the arrangement of FIG. 1.

DESCRIPTION OF THE PREFERRED EMBODIMENT

The present invention, as best illustrated in FIG. 1, is an outlet circuit arrangement generally designated 5, for a furnace of a steam generator, which reduces the number of furnace outlet headers and material required with known furnace outlet circuits.

The arrangement 5 utilizes a fluid mix header 30 which contains the total mix for the furnace outlet fluid. The fluid mix header 30 receives fluid from the furnace rear screen tubes 18 and the front screen tubes 16 which are both connected to the fluid mix header 30. The screen tubes 16 and 18 are located near and as a continuation of the furnace arch centerline 22 and furnace rear wall centerline tube 20 as illustrated. Although only one furnace front screen tube 16 and two rear screen tubes 18 are shown schematically for ease of illustration, it should be understood that a plurality of each of these tubes are used in carrying out the invention.

The arrangement 5 also includes a furnace roof outlet header 24 located at the roof of the furnace. A furnace roof tube 10 is connected at one end to the roof outlet header 24 and at the opposite end to one end of a front wall support loop 40 located near a furnace side wall outlet header 26. A furnace front wall tube 12 is connected to the opposite end of the front wall support loop 40 such that fluid flows upwardly through the front wall tube 12 around the loop tube 40, through the furnace roof tube 10, and into the furnace roof outlet header 24. As indicated above, only one front wall tube 12, roof outlet header, support loop 40, and furnace roof tube 10 are shown for ease of illustration. It should be understood that a plurality of these tubes are used in carrying out the invention.

A plurality of furnace side wall tubes 14 are connected to and in fluid communication with the furnace side wall outlet header 26 for providing fluid thereto.

The furnace front wall support loop 40 is used in lieu of front wall outlet headers and roof tube inlet headers which are generally found in known furnace outlet circuits.

A plurality of riser tubes 28 are connected to the furnace side wall outlet header 26 for carrying fluid to the fluid mix header 30. Riser sections 29 receive fluid from the furnace roof outlet header 24 and then direct the fluid to the fluid mix header 30.

The risers 28 are used to provide fluid from the side wall outlet header 26 to the fluid mix header 30. The furnace front screen tube 16 and the furnace rear screen tubes 18 flow directly into the fluid mix header 30, thus eliminating the need for the additional headers and risers commonly used in known furnace outlet circuits.

Fluid from the fluid mix header 30 is provided via convection pass downcomer 48, which supplies fluid to the convection pass enclosure walls and roof circuits. Tube 50 represents the convection pass roof circuit which will discharge its fluid to the convection pass outlet fluid mix that is not shown.

FIG. 2 illustrates a front wall support loop 42 where the tube does not cross over itself and it defines a concave or indented shape 44 as shown. Front wall support loop 42 can be used in lieu of the front wall support loop 40 shown in FIG. 1. Both of the front wall loop embodiments 40 and 42 provide an arrangement which eliminates headers, tubing, risers and other material normally associated with known fluid outlet circuits. The present invention substantially reduces the costs associated with the manufacture, construction, and operation of furnace fluid outlet circuits.

While a specific embodiment of the invention has been shown and described in detail to illustrate the application of the principles of the invention, it will be understood that the invention may be embodied otherwise departing from such principles.

What is claimed as invention is:

1. An arrangement for a furnace of a once-through steam generator having convection pass circuitry, comprising:

a. a fluid mix header for containing a volume of a fluid;

b. a side wall header at a side wall of the furnace;

c. at least one side wall tube at the side wall of the furnace, said side wall tube being connected to said side wall header;

d. an outlet header at the roof of the furnace;

e. a loop section of tube;

f. a roof tube at the roof of the furnace connected at one end to said outlet header and at the opposite end to one end of said loop section of tube;

g. a front wall tube at the front of the furnace connected to the opposite end of said loop section of tube from said roof tube;

f. a tube connected between said outlet header and said fluid mix header;

g. a plurality of screen tubes connected to said fluid mix header; and h. means for providing fluid from said fluid mix header to the convection pass circuitry of the furnace.

2. The arrangement according to claim 1, including a plurality of riser tubes connected between said side wall header and said fluid mix header.

* * * * *